United States Patent [19]

Engle et al.

[11] Patent Number: 4,650,351

[45] Date of Patent: Mar. 17, 1987

[54] THERMAL PRINTER

[75] Inventors: Vencil D. Engle, Lexington, Ky.; Cameron H. Hafer, San Jose, Calif.; Frank M. Hughes, Paris, Ky.; Donald J. Steger, Corinth, Ky.; Edward G. Stewart, Harrodsburg, Ky.; Ramon L. Street, San Jose, Calif.; John A. Thompson, Lexington, Ky.

[73] Assignee: International Business Machines Corporation, Armonk, N.Y.

[21] Appl. No.: 729,023

[22] Filed: Apr. 30, 1985

[51] Int. Cl.[4] ..... B41J 3/02; B41J 35/28

[52] U.S. Cl. ..... 400/120; 400/229; 400/234; 400/235; 400/207; 242/197

[58] Field of Search ..... 400/194, 196, 196.1, 400/223, 227.1, 234, 235, 235.1, 207–208, 208.1, 120, 224, 228–229, 248–249; 242/197–200

[56] References Cited

U.S. PATENT DOCUMENTS

| | | | |
|---|---|---|---|
| 3,815,899 | 6/1974 | Hatzmann | 271/80 |
| 3,831,731 | 8/1974 | Mack et al. | 400/234 |
| 3,846,812 | 11/1974 | Biber . | |
| 4,210,403 | 7/1980 | Mazouet et al. | 400/235.1 |
| 4,329,075 | 5/1982 | Appelgate et al. | 400/234 |
| 4,337,001 | 6/1982 | Lappotto | 400/208 |
| 4,378,566 | 3/1983 | Tsukamura | 400/234 |
| 4,397,574 | 8/1983 | Wojdyla | 400/235.1 |
| 4,413,920 | 11/1983 | Matthias et al. . | |
| 4,544,291 | 10/1985 | Nagata et al. | 400/234 |

FOREIGN PATENT DOCUMENTS

| | | | |
|---|---|---|---|
| 28873 | 5/1981 | European Pat. Off. | 400/234 |
| 82957 | 7/1983 | European Pat. Off. | 400/208 |
| 30886 | 3/1981 | Japan | 400/207 |
| 201684 | 12/1982 | Japan | 400/208 |
| 73984 | 4/1984 | Japan | 400/235.1 |

OTHER PUBLICATIONS

"Ribbon Feed Mechanism", IBM Technical Disclosure Bulletin, vol. 27, No. 1A, Jun. 1984, pp. 204–207.

"Ribbon Release to Prevent Breakage", IBM Technical Disclosure Bulletin, vol. 25, No. 8, Jan. 1983, pp. 4056–4057.

"Ribbon Cartridge Having Self-Induced Take-Up Motion", IBM Tech. Discl. Bulletin, vol. 27, No. 10B, Mar. 1985, pp. 6356–6357.

*Primary Examiner*—E. H. Eickholt

*Attorney, Agent, or Firm*—Frank C. Leach, Jr.; John A. Brady

[57] ABSTRACT

A thermal printer (10) has a thermal transfer medium (28) fed past a thermal printhead (21) at a substantially constant velocity by a feed roll (82) engaging the thermal transfer medium just prior to the printhead to maintain a portion of the thermal transfer medium between the printhead and the feed roll relatively stiff. The feed roll is mounted on a cartridge (30) having the thermal transfer medium supplied therefrom. A drag brake (70) is disposed in the feed path of the thermal transfer medium prior to the feed roll to cause a substantially constant premetering tension to be applied to the thermal transfer medium irrespective of the coefficient of friction between the drag brake and the thermal transfer medium. A carrier (14), which supports the printhead and a feed roll driver (90), is driven separately from the feed roll driver so that various ratios between the velocities of the thermal transfer medium and the carrier are obtained to produce various print qualities. One print quality occurs in a draft mode, which is a relatively high speed, in which there is substantial conservation of the thermal transfer medium. The peel angle of the thermal transfer medium from a recording medium (12) on which printing occurs is maintained at a relatively low angle to increase the contact time between the thermal transfer medium and the recording medium.

36 Claims, 18 Drawing Figures

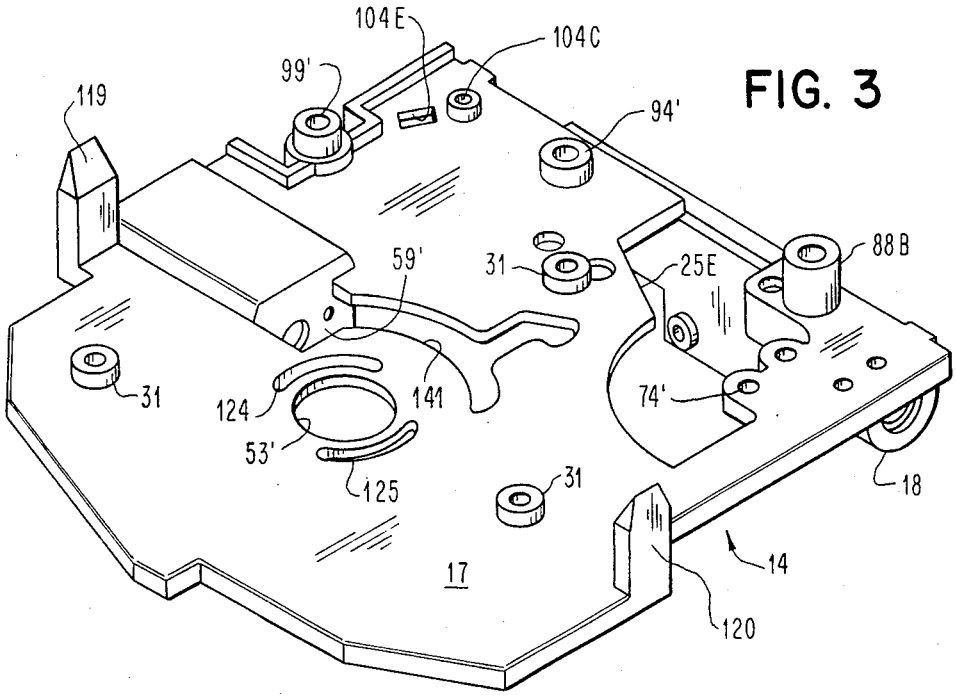
FIG. 3
FIG. 4
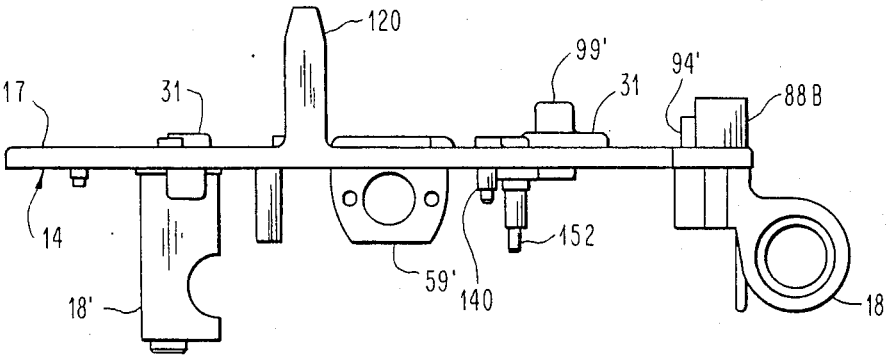

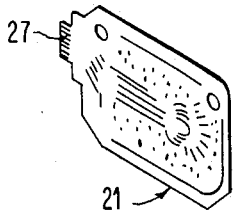
FIG. 5
FIG. 6
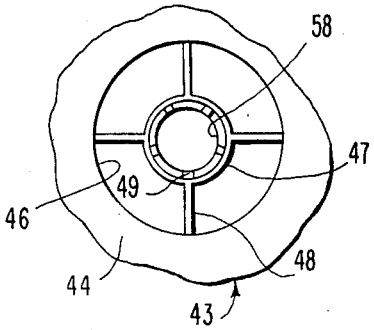
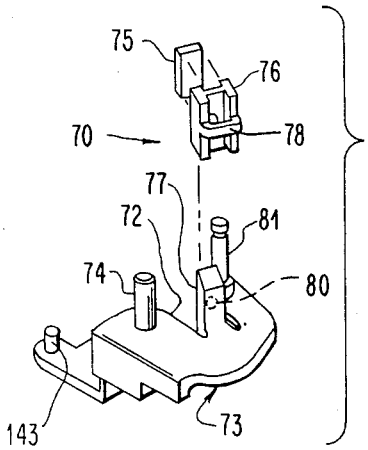
FIG. 8
FIG. 9
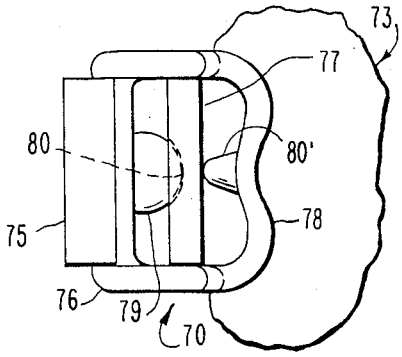

FIG. 16
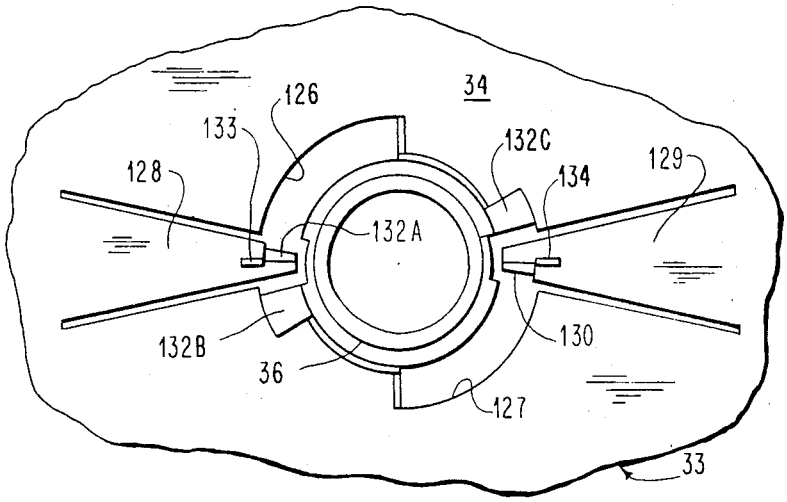
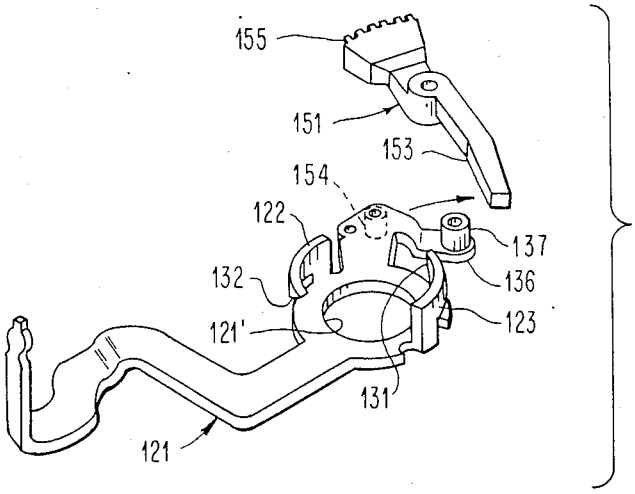
FIG. 11

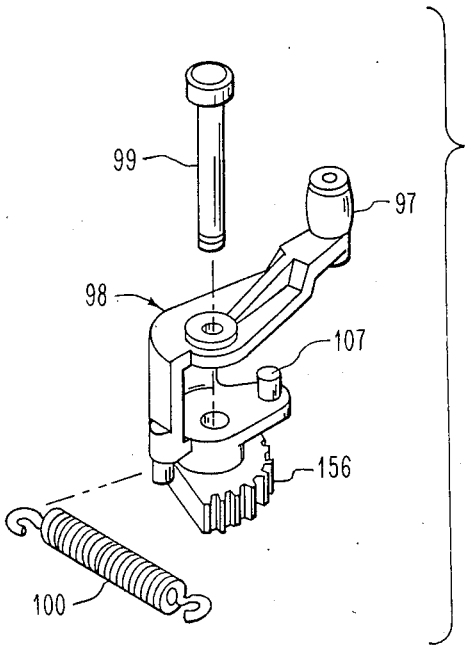
FIG. 13
FIG. 14
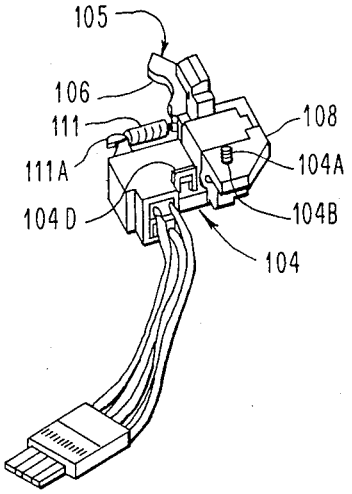
FIG. 15
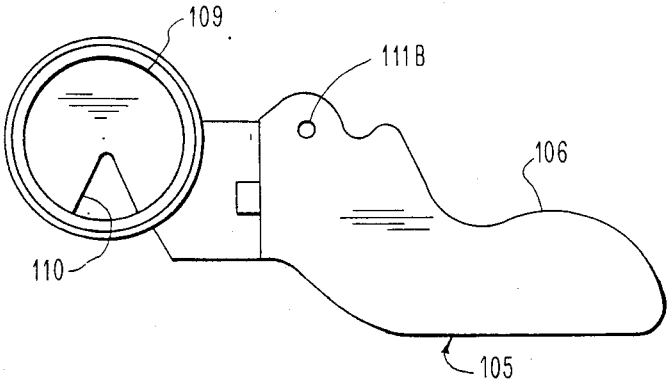

THERMAL PRINTER

CROSS REFERENCE TO RELATED PATENT APPLICATION

The copending patent application of Steven L. Applegate et al for "Thermal Transfer Medium Feeding For Conservation Including Two-Mode Embodiments," Ser. No. 640,208, filed Aug. 10, 1984, now U.S. Pat. No. 4,558,963, and assigned to the same assignee as the assignee of this application, is incorporated by reference.

BACKGROUND OF INVENTION

1. Field of the Invention

This invention relates to a thermal printer and, more particularly, to a feeding mechanism for a thermal printer in which there is conservation of a thermal transfer medium from which a marking material is transferred when it is softened by heat to a flowable state.

2. Description of the Prior Art

It has previously been suggested in the aforesaid Applegate et al application to have conservation of a thermal transfer medium such as an inked ribbon, for example, by underfeeding the ribbon relative to movement of a thermal printhead of a thermal printer. This results in the ribbon sliding relative to both the printhead and a recording or receiving medium such as a sheet of paper, for example, during formation of the print.

In the preferred embodiment of the aforesaid Applegate et al application, feeding of both a carrier which carries the printhead and the ribbon occurs from a single power source through using gears and selectively changing the gear ratios to feed the ribbon at different velocities relative to the velocity of the printhead. The aforesaid Applegate et al application also suggests that two separate power sources could be utilized for driving the carrier which carries the printhead and the ribbon.

The feeding of the ribbon in the aforesaid Applegate et al application is accomplished by having a pair of pinch rolls engage the ribbon after using the ribbon to print on the sheet of paper. The ribbon feeding mechanism of the aforesaid Applegate et al application also has drag brake means between the source of the ribbon and the printhead to create a tension on the ribbon at the print point.

The present invention is an improvement of the thermal printer of the aforesaid Applegate et al application. It has been found that the sliding force of the ribbon against the sheet of paper has a sufficient magnitude to pull the ribbon from the supply spool during printing in the thermal printer of the aforesaid Applegate et al application. Thus, while the ribbon feed mechanism of the aforesaid Applegate et al application conserves ribbon, accurate metering of the ribbon relative to the paper is not always obtainable because of the inability of a brake/tensioning mechanism of the ribbon feed mechanism of the aforesaid Applegate et al application to restrain the ribbon with any repeatability and reliability.

To obtain accurate metering of the ribbon relative to the sheet of paper, the ribbon feeding mechanism must pull the ribbon from its cartridge and meter it onto the sheet of paper at a consistent velocity irrespective of variations in the unwind tension and the frictional characteristics of the ribbon. This must occur without damaging the ribbon such as by scratching, wrinkling, or overstressing the ribbon, for example, prior to printing.

While the thermal printer of the aforesaid Applegate et al application conserves ribbon, there is no recognition that consistent conservation of the ribbon can be obtained where the premetering tension, which is the tension on the ribbon prior to the metering roll and is the sum of the tension created by drag brake means and the unwind tension, is maintained substantially constant and the take-up tension is maintained substantially constant as the feed mechanism of the present invention can accomplish. By maintaining the ratio of the take-up tension to the premetering tension at a selected value since the two tensions can be maintained substantially constant, slippage of the ribbon during feeding is avoided.

In the aforesaid Applegate et al application, the magnitude of the drag brake tension, which constitutes part of the premetering tension in addition to the unwind tension, is the product of the coefficient of friction between the ribbon and the pad of the drag brake and the normal force of the ribbon on the pad. The coefficient of friction does not remain constant because each ribbon has variations from other ribbons to create slight differences in the coefficient of friction with the pad of the drag brake. Further changes in the coefficient of friction occur due to wear of the surfaces over which the ribbon passes and the build up of contaminants over such surfaces. Thus, these variations in the coefficient of friction do not enable a consistent velocity to be applied to the ribbon so that the most effective conservation of the ribbon is not obtained.

It should be understood that the drag brake is opened when the drag brake tension increases beyond a predetermined tension so that there is no control of the premetering tension during this time. After a period of time, the drag brake again closes to again enable control of the premetering tension. Accordingly, an increase in the coefficient of friction causes more frequent opening of the drag brake to cause more frequent fluctuation in the premetering tension.

There also are changes in the coefficient of friction due to ribbon feed leaders, whch have a very low coefficient of friction, and the ribbon ends, which may be abrasive so as to have a relatively high coefficient of friction. Each of these has an effect on the velocity of the ribbon when these portions of the ribbon pass the drag brake.

The present invention solves the problem of the changes in the frictional characteristics of the ribbon causing variations in the premetering tension through utilizing an arrangement in which changes in the coefficient of friction between the ribbon and the material of the drag brake has no substantial effect on the premetering tension. This is accomplished through relieving the normal force of the ribbon on the pad of the drag brake as the coefficient of friction increases. Thus, there is not a linear increase in the premetering tension due to an increase in either the coefficient of friction or the normal force as occurs in the aforesaid Applegate et al application.

It also has been discovered that another effect on the feed velocity of the ribbon occurs during printing because of changes in friction between the thermal printhead and the ribbon and between the sheet of paper and the ribbon. During printing, heat from the electrodes of the printhead increases the friction between the printhead and the ribbon and decreases the friction between the sheet of paper and the ribbon. As these changes in friction occur, the ribbon has to stretch or relax depending on the net force change. The minimization of stretching or relaxing of the ribbon occurs when the stiffness of the ribbon is at a maximum in the area just prior to the printhead.

The present invention solves this problem through positioning feed means for the ribbon as close as possible to the printhead and prior to the printhead. The location of the feed means prior to the printhead eliminates the use of any type of pinch or nip rolls as is shown in the aforesaid Applegate et al application and on pages 204–207 of Volume 27, No. 1A (June 1984) issue of the IBM Technical Disclosure Bulletin.

While the aforesaid IBM Technical Disclosure Bulletin shows nip rolls engaging the ribbon prior to the printhead, these could damage the ribbon prior to printing so that the nip rolls of the aforesaid IBM Technical Disclosure Bulletin are undesirable for feeding the ribbon prior to the printhead. There also is no recognition in the aforesaid IBM Technical Disclosure Bulletin of disposing the nip rolls as close as possible to the printhead to maintain the portion of the ribbon between the nip rolls and the printhead substantially stiff to minimize stretching or relaxing of the ribbon during printing and minimize any appreciable effect on the velocity of the ribbon.

While the aforesaid IBM Technical Disclosure Bulletin discusses a constant tension on the supply spool, this is based on an assumption that the coefficient of friction between the ribbon and the braking surface pad remains constant. However, the coefficient of friction of different ribbons relative to the pad is not normally the same, and there is wear of the pad and/or build up of ink on the pad so as to change the coefficient of friction between the ribbon and the pad. As previously discussed, each of these variations has a significant effect on the coefficient of friction so as to change the premetering tension whereby it would not be constant.

To avoid damage to the ribbon prior to printing, the present invention uses a single feed or metering roll, which engages the ribbon prior to the printhead, having a high coefficient of friction with the ribbon. The ribbon also has a relatively large wrap angle around the feed or metering roll. This high coefficient of friction and the large wrap angle insures that there is no slippage of the ribbon relative to the feed or metering roll.

The ribbon feed roll of the present invention also is subjected to build up of ink on its outer surface so as to have its coefficient of friction with the ribbon changed over a period of time. The continued use of the contaminated feed roll would result in an inconsistent feed velocity because slippage of the ribbon relative to the metering roll could occur due to the reduced coefficient of friction.

This problem is solved through mounting the feed roll on a cartridge having the ribbon supply. Accordingly, the feed roll is replaced each time that the cartridge is replaced so that the need for any cleaning of the feed roll is avoided. The use of the feed roll is in accordance with the amount of ribbon employed, and the quantity of ribbon in the cartridge is selected so that there is not any significant change in the coefficient of friction between the ribbon and the feed roll before the ribbon is exhausted.

As previously mentioned, the thermal printer of the present invention has an arrangement to reduce the normal force of the ribbon on the drag brake pad as the ribbon passes through the drag brake when the coefficient of friction increases. This arrangement also is employed to guide the ribbon to cause the ribbon to wrap around more than 90° of the feed roll.

The thermal printer of the present invention is an improvement of the thermal printer of the aforesaid Applegate et al application in that the ribbon may be fed at various selected velocities through its own power source. The carrier which carries the printhead is driven from a second power source at various selected velocities. While the aforesaid Applegate et al application discussed the use of two separate power sources for feeding the ribbon and driving the carrier, there is no recognition in the aforesaid Applegate et al application that more than two conservation modes (draft and quality) could be utilized although there is a description of a very large range of ratios and velocities.

The thermal printer of the present invention may operate in three different conservation modes (draft, quality, and enhanced) with the underfeed ratios (the ratio of the print speed to the ribbon feed rate) being 5:1, 2:1, and 1.2:1, respectively. With the carrier having a very high speed such as 160 characters per second with ten pitch characters, the thermal printer of the present invention is in the draft mode wherein the conservation of the ribbon enables the ribbon cost when printing in the draft mode to be in the same range as that of a fabric ribbon used with a high speed, dot matrix printer. When operating the carrier of the thermal printer of the present invention at a speed of 100 characters per second with ten pitch characters, the quality mode is obtained to produce letter quality print. At a lower speed such as 80 characters per second with ten pitch characters, the enhanced mode occurs to produce the best print.

While the thermal printer of the present invention is capable of very high speed printing when operating in the draft mode, it still does not exceed the maximum current for a selected ribbon length in a selected period of time that can be produced from the electrodes of the thermal printhead. Because of the higher speed of the printhead and the lower speed of the ribbon, there is a longer dwell at each character space by the ribbon; this allows utilization of a lower current for a selected ribbon length in a selected period of time even though the total current may be relatively large.

SUMMARY OF THE INVENTION

The feed mechanism of the present invention feeds ribbon at a substantially constant velocity, irrespective of variations in the ribbon, and avoids significant changes in the premetering tension due to changes in the coefficient of friction between the ribbon and the drag brake. This is accomplished through decreasing the normal force of the ribbon on the drag brake pad as the coefficient of friction between the ribbon and the drag brake increases and conversely.

By mounting the feed roll on the cartridge, the use of the feed roll is controlled so that its use is not so long as to require the feed roll to be cleaned but is automatically replaced when the ribbon in the cartridge is fully used. This avoids the danger of the feed roll having the ribbon slip relative thereto because of a substantial change in the coefficient of friction due to build up of contaminants on the feed roll so as to affect the feeding of the ribbon.

Through maintaining a substantially constant premetering tension, the thermal printer of the present invention is capable of having substantially constant tensions applied to portions of the ribbon on opposite sides of the feed roll. This avoids any slippage of the ribbon on the feed roll.

The positioning of the single feed roll prior to the printhead avoids the problem of damaging the ribbon while still obtaining the desired feed rate through having a desired coefficient of friction between the ribbon and the feed roll and a substantial wrap around of the ribbon on the feed roll. The changes in frictions between the thermal printhead and the ribbon and between the sheet of paper and the ribbon during printing due to heating of the ribbon do not have a significant effect on the ribbon because the ribbon is substantially stiff between the printhead and the feed roll through positioning the feed roll as close as possible to the printhead.

As the speed of the printhead increases, the contact time of the ribbon with the sheet of paper decreases. To insure that there is sufficient contact time of the ribbon with the sheet of paper to have satisfactory print, particularly in the draft mode, the peel angle of the ribbon should be decreased. The present invention accomplishes this through disposing control means beyond the printhead and before the take-up spool to control the peel angle between the sheet of paper and the tension producing means. A satisfactory peel angle is within the range of 1° to 10° with the preferred angle being 7.9°.

An object of this invention is to provide a mechanism for feeding a transfer medium of a thermal printer at a substantially constant selected velocity past a thermal printhead.

Another object of this invention is to provide a thermal printer having at least three printing modes for conservation of a transfer medium of a thermal printer.

A further object of this invention is to provide a transfer medium cartridge for a thermal printer in which a feed roll for feeding the transfer medium is supported by the cartridge.

Still another object of this invention is to provide a thermal printer in which substantially constant tensions are applied to the ribbon on opposite sides of the feed roll irrespective of the coefficient of friction of the transfer medium.

A still further object of this invention is to provide a feed mechanism for feeding a transfer medium of a thermal printer at different velocities for different velocities of a thermal printhead.

The foregoing and other objects, features, and advantages of the invention will be apparent from the following more particular description of the preferred embodiment of the invention as illustrated in the accompanying drawings.

BRIEF DESCRIPTION OF THE DRAWINGS

In the drawings:

FIG. 3 is a perspective view of a carrier of the thermal printer of FIG. 1 without any parts mounted on the carrier.

FIG. 4 is a side elevational view of the carrier of FIG. 3.

FIG. 5 is a perspective view of a portion of the thermal printhead of FIG. 1 and showing its electrodes.

FIG. 6 is a fragmentary bottom plan view of a central portion of a take-up spool of the cartridge of FIG. 2.

FIG. 8 is an exploded perspective view of portions of a drag brake of the thermal printer of FIG. 1.

FIG. 9 is an enlarged top plan view of a portion of the drag brake of FIG. 8.

FIG. 11 is a perspective view of a lever for locking and unlocking the cartridge to the carrier of the thermal printer of FIG. 1 and an arm for moving a tension arm of the thermal printer of FIG. 1 to an inactive position when the cartrige is removed from the carrier.

FIG. 13 is an exploded perspective view of a tension arm of the thermal printer of FIG. 1.

FIG. 14 is a perspective view of an optical sensor for sensing the position of the tension arm.

FIG. 15 is a top plan view of a rotatable flag of the optical sensor of FIG. 14.

FIG. 16 is an enlarged fragmentary top plan view of a housing base of the supply cartridge of FIG. 2.

DETAILED DESCRIPTION

Figure 1:
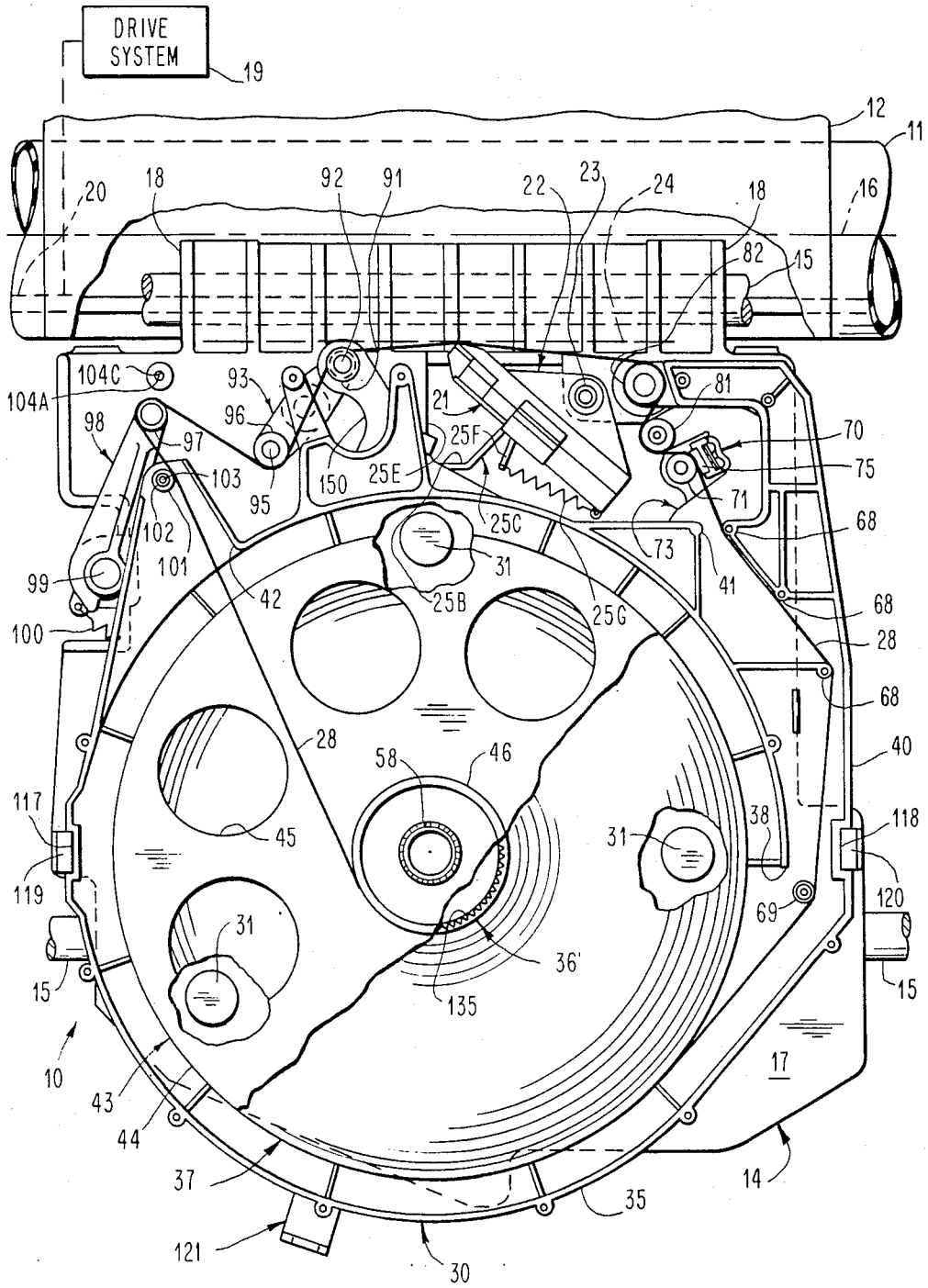
FIG. 1 is a top plan view of a portion of a thermal printer having a feed mechanism for feeding a thermal transfer medium.

Referring to the drawings and particularly FIG. 1, there is shown a thermal printer 10. The thermal printer 10 includes an elongated, cylindrical platen 11 adapted to support a receiving or recording medium 12 such as a sheet of paper, for example, for receiving printing marks to be recorded thereon.

The thermal printer 10 has a carrier 14 slidably mounted on rails 15 for movement parallel to a longitudinal axis 16 of the platen 11. The carrier 14 includes a flat plate 17 (see FIG. 3) having a pair of bearing supports 18 integral therewith and extending downwardly therefrom to slide along one of the rails 15 (see FIG. 1). The flat plate 17 (see FIG. 4) of the carrier 14 has a retainer 18′ extending downwardly therefrom to slide along the other of the rails 15 (see FIG. 1). The carrier 14 is driven from a suitable drive system 19 (shown illustratively in FIG. 1) through a timing belt 20, which is attached to the carrier 14, connecting the drive system 19 to the carrier 14.

Figure 17:
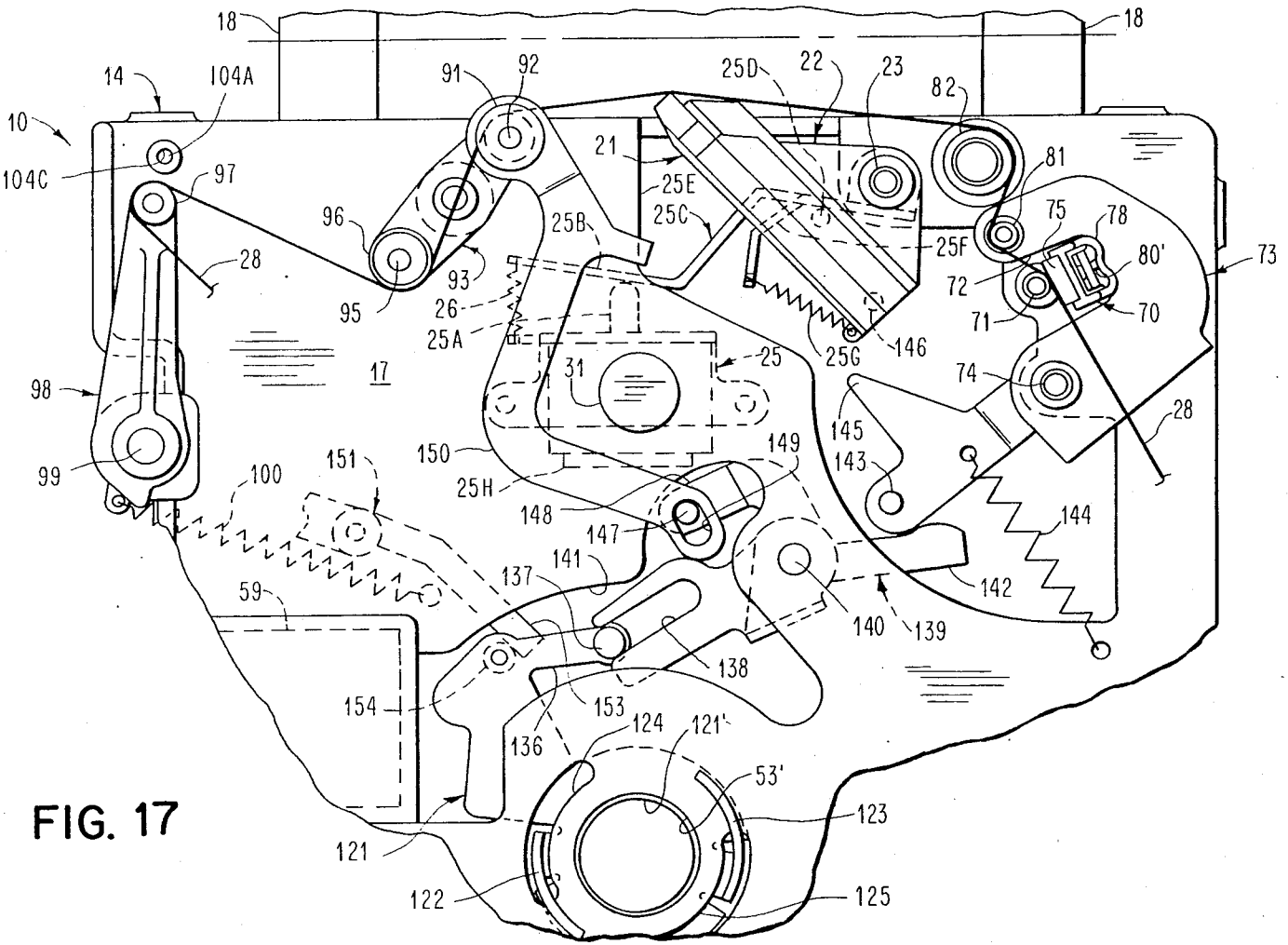
FIG. 17 is an enlarged fragmentary top plan view of a portion of the carrier of the thermal printer of FIG. 1 without the cartridge but showing a portion of the thermal transfer medium and its feed roll.

A printhead 21 is mounted on a holder 22, which is pivotally mounted on a pivot pin 23 supported on the plate 17 of the carrier 14 and extending upwardly therefrom. Movement of the printhead 21 from a retracted position to an operative position at a print line 24 is produced by energizing a solenoid 25 (see FIG. 17), which is supported on the bottom of the plate 17, in a manner similar to that more particularly shown and described in the aforesaid Applegate et al application.

The energization of the solenoid 25 causes extension of a plunger of the solenoid 25 so that a pin 25A on the end of the plunger engages a lower arm 25B of a bracket 25C, which is pivotally mounted on the pivot pin 23, to pivot the bracket 25C clockwise about the pivot pin 23. This causes the printhead holder 22 to be pivoted clockwise with the bracket 25C due to a pin 25D on a portion of the bottom of the printhead holder 22 beneath the printhead 21 extending through an opening 25E in the plate 17 of the carrier 14 and being held against an upper arm 25F of the bracket 25C by a spring 25G, which extends between the upper arm 25F and the printhead holder 22.

When the printhead 21 engages the platen 11 (see FIG. 1), movement of the printhead holder 22 is stopped, but there is a slight further movement of the bracket 25C (see FIG. 17) due to the plunger of the solenoid 25 having its motion stopped by a disc 24H, which is attached to the plunger of the solenoid 25, abutting the rear end of the solenoid 25. This results in the spring 25G loading the printhead 21 against the medium 12 (see FIG. 1). When the solenoid 25 (see FIG. 17) is deenergized, a return spring 26 returns the printhead 21 to its retracted position.

The printhead 21 has a plurality of electrodes 27 (see FIG. 5) arranged in a single line array. The electrodes 27, which are held in the loaded position by the spring 25G (see FIG. 17), are selectively energized in response to signals and generate heat in portions of a transfer medium 28 (see FIG. 1) to cause marking material of the transfer medium 28 to be transferred to the medium 12 when the marking material is softened to a flowable state by the heat from the electrodes 27 (see FIG. 5) of the printhead 21. The transfer medium 28 (see FIG. 1) may be any suitable material for transferring printing marks to the medium 12 in accordance with the heat supplied from the particular energized electrodes 27 (see FIG. 5) of the printhead 21 such as the inked ribbon shown and described in the aforesaid Applegate et al application.

Figure 2:
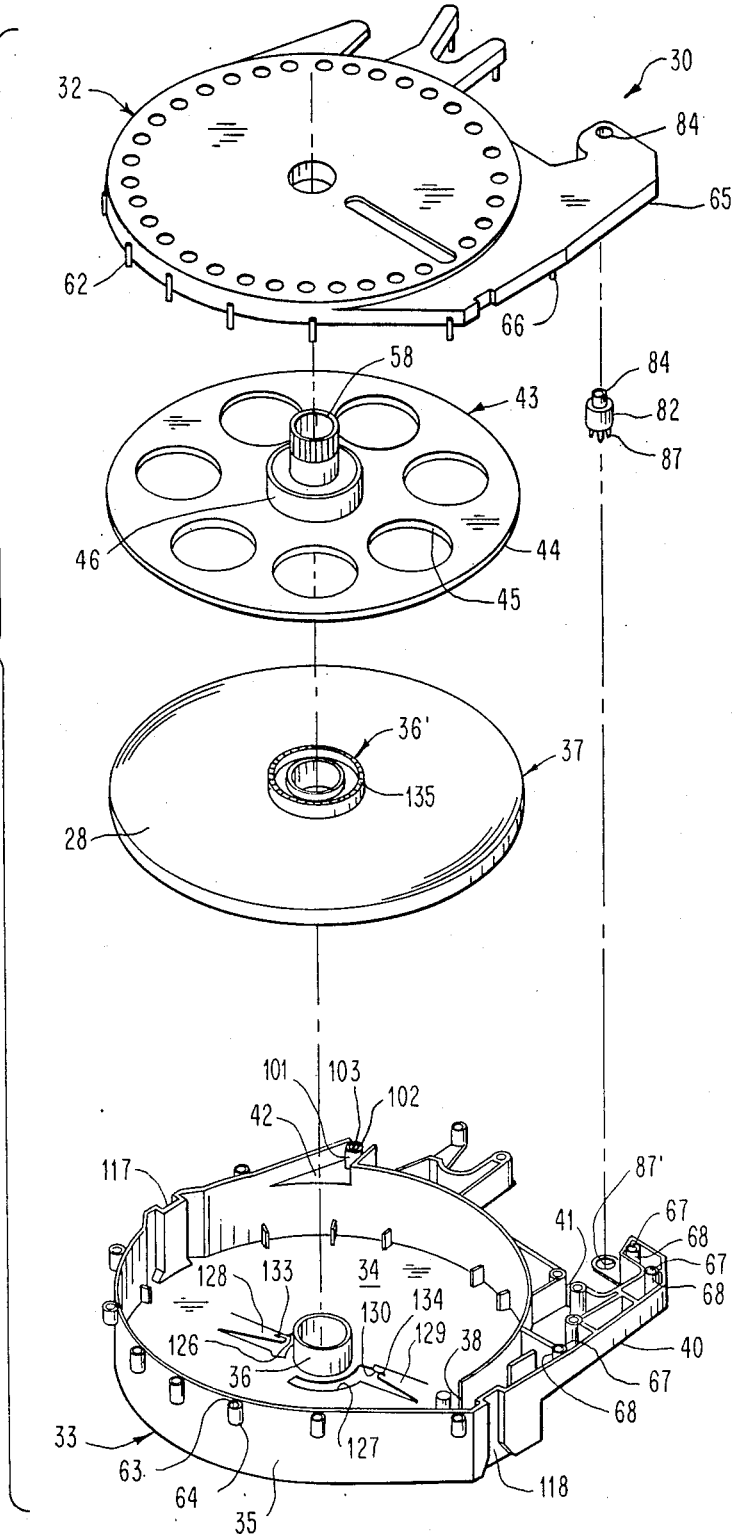
FIG. 2 is an exploded perspective view of a thermal transfer medium supply cartridge employed with the thermal printer of FIG. 1.

The transfer medium 28 (see FIG. 1) is supported in a cartridge 30, which is removably supported on pads 31 located on the plate 17 of the carrier 14. As shown in FIG. 2, the cartridge 30 includes a housing or main body formed of an upper portion or cover 32 connected to a lower portion or base 33.

The housing base 33 includes a substantially planar floor 34 having a side wall 35 extending upwardly therefrom. An annular bearing portion 36 extends upwardly from the floor 34 of the housing base 33 and has a core 36', which has the transfer medium 28 wrapped thereon, of a supply spool 37 rotatably supported thereby. The transfer medium 28 on the core 36' of the supply spool 37 exits from the housing base 33 through a first opening 38 in the side wall 35 into an extension 40 of the housing base 33 from which the transfer medium 28 exits through a first opening 41.

The transfer medium 28 returns to the interior of the housing base 33 through a second opening 42 in the side wall 35 to provide a continuous span or length of the transfer medium 28 exterior of the cartridge 30. The second opening 42 does not extend throughout the height of the side wall 35 but only in the upper portion so that the transfer medium 28 is returned to the cartridge 30 for being wound around a take-up spool 43 in a different plane than the supply spool 37. The transfer medium 28 is changed from the plane of the supply spool 37 in the extension 40 of the housing base 33 of the cartridge 30.

The take-up spool 43 includes a plate 44, which has holes 45 therein to lighten the weight to reduce the inertia, having an outer cylindrical portion 46 around which the transfer medium 28 is wrapped as the take-up spool 43 is rotated. The interior of the outer cylindrical portion 46 is hollow so that a hub 47 (see FIG. 6) is formed within the outer cylindrical portion 46. Ribs 48 extend from the hub 47 to the inner surface of the outer cylindrical portion 46.

Figure 7:
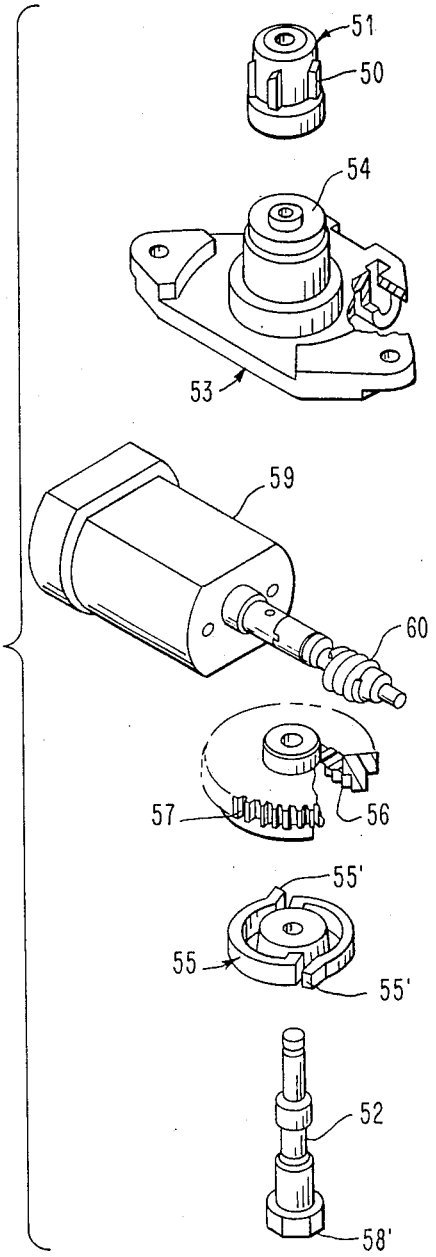
FIG. 7 is an exploded perspective view of the drive arrangement for the take-up spool of the cartridge of FIG. 2.

The interior of the hub 47 is hollow and has five teeth 49 thereon for meshing with five teeth 50 (see FIG. 7) on a driver 51. The driver 51 is attached to the upper end of a shaft 52, which is rotatably supported to a housing 53 fixed to the bottom of the plate 17 (see FIG. 1) of the carrier 14, for rotation therewith. A portion of the housing 53 (see FIG. 7) extends through a circular opening 53' (see FIG. 3) in the plate 17 of the carrier 14. Because of the shaft 52 (see FIG. 7) having the driver 51 fixed thereto, the engagement of the bottom of the driver 51 with an upper surface 54 of the housing 53 holds the shaft 52 within the housing 53 while allowing rotation therein.

A pawl 55 is attached to the shaft 52 for rotation therewith and has ends 55' cooperating with ratchet teeth 56 on an inner surface of a gear 57 to form a one-way clutch to enable rotation of the shaft 52 without rotation of the gear 57. This occurs when a knob 58 (see FIG. 2) on the outer cylindrical portion 46 is turned when the cartridge 30 is initially installed on the carrier 14 (see FIG. 1) to take up any slack in the transfer medium 28 between the supply spool 37 (see FIG. 2) and the take-up spool 43. The pawl 53 (see FIG. 7) rests on a head 58' on the end of the shaft 52.

The take-up spool 43 (see FIG. 2) is supported on the driver 51 (see FIG. 7) so that it is rotated whenever the driver 51 rotates through the teeth 50 on the driver 51 meshing with the teeth 49 (see FIG. 6) on the hub 47 of the take-up spool 43. The driver 51 (see FIG. 7) is driven from a take-up motor 59, which is supported on a plate 59' (see FIG. 4) extending downwardly from the bottom of the plate 17 of the carrier 14, through a worm gear 60 (see FIG. 7) meshing with the gear 57. Thus, when the cartridge 30 (see FIG. 1) is mounted on the carrier 14, the take-up spool 43 (see FIG. 2) is supported on the driver 51 (see FIG. 7) for rotation therewith.

The housing cover 52 (see FIG. 2) has pins 62 extending downwardly from its periphery for disposition within holes 63 in cylindrical portions 64 on the outer surface of the side wall 35 of the housing base 33 to connect the cover 32 and the base 33 to each other. An extension 65 on the cover 32 has similar pins 66 for disposition within holes 67 in upstanding cylindrical portions 68 in the extension 40. As shown in FIG. 1, the transfer medium 28 passes around a roller 69 upon entering the extension 40 after exiting through the opening 38 and then in engagement with some of the cylindrical portions 68 within the extension 40 until the transfer medium 28 exits from the extension 40 of the cartridge 30 through the opening 41.

After leaving the cartridge 30, the transfer medium 28 passes through a drag brake 70 on the carrier 14. The drag brake 70 includes a back-up pin 71, which is supported on the plate 17 of the carrier 14 and extends upwardly through a cut out portion 72 (see FIG. 17) in a plate or arm 73 of the drag brake 70. The plate 73 is pivotally mounted on the carrier 14 by a pivot pin 74 supported in an opening 74' (see FIG. 3) in the flat plate 17 of the carrier 14.

The drag brake 70 (see FIG. 8) includes a pad 75, which is preferably formed of felt, supported in a holder 76. The holder 76 is disposed on an upstanding finger 77 of the plate 73 and has a portion 78 on the opposite side of the finger 77 from the pad 75. The holder 76 has a spherical portion 79 (see FIG. 9) engaging a socket 80 in the finger 77 to gimbally mount the holder 76 thereon so that the pad 75 engages the entire depth of the transfer medium 28 (see FIG. 17) as it passes between the back-up pin 71 and the pad 75. The portion 78 has a projection 80' (see FIG. 9) engaging the finger 77 on the side opposite from the socket 80 to provide stability.

Figure 12:
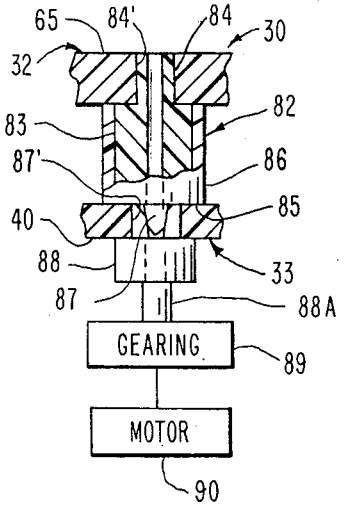
FIG. 12 is a fragmentary sectional view, partly schematic, of a portion of a cartridge of the thermal printer of FIG. 1 and showing a feed roll supported by the cartridge and illustrating its drive.

After the transfer medium 28 (see FIG. 17) passes through the drag brake 70, the transfer medium 28 passes around an idler 81, which is supported on the plate 73 in a position to guide the transfer medium 28 from the drag brake 70 to a feed or metering roll 82. The feed roll 82 is rotatably supported by the cartridge 30. As shown in FIG. 12, the feed roll 82 includes a core 83, which is formed by injection molding of a suitable hard, dimensionally stable plastic such as glass-filled polyester, for example, having an upper bearing surface 84 rotatably supported in an opening 84' in the extension 65 of the housing cover 32 of the cartridge 30 and its lower surface 85 rotatably supported on the upper surface of the extension 40 of the housing base 33 of the cartridge 30.

The core 83 has an outer surface 86 of a material having a relatively high coefficient of friction (e.g., greater than 0.7 and preferably 1.2) with the material of the transfer medium 28 (see FIG. 1) and preferably being elastomeric. It also is desirable for the material of the outer surface 86 (see FIG. 12) of the feed roll 82 to have some softness to aid in tracking the transfer medium 28 (see FIG. 1). Any differential loads across the height of the feed roll 82 (see FIG. 12) can be compensated to a degree by compression of the material of the outer surface 86 of the feed roll 82 during feeding of the transfer medium 28 (see FIG. 1). Suitable examples of the material of the outer surface 86 (see FIG. 12) of the feed roll 82 are urethane rubber, polyvinyl chloride, and microcellular urethane foam with the microcellular urethane foam being preferred.

By making the outer surface 86 of the feed roll 82 as thin as possible, a high torsional rigidity is obtained. This relative thinness of the outer surface 86 is obtained by injection molding the outer surface 86 on the core 83. The preferred thickness of the outer surface 86 of the feed roll 82 is 0.5 mm or less.

The core 83 of the feed roll 82 has teeth 87 extending downwardly therefrom through an opening 87' in the extension 40 of the housing base 33 of the cartridge 30 for cooperating with teeth on a driver 88, which is attached to the upper end of a shaft 88A rotatably supported in a bushing 88B (see FIG. 3) on the carrier 14. The bottom end of the shaft 88A (see FIG. 12) has a gear forming part of gearing 89 (illustratively shown) driven from a motor 90 illustratively shown), which is supported from the bottom of the plate 17 (see FIG. 1) of the carrier 14.

Thus, the feed roll 82 (see FIG. 12) is supported on the cartridge 30 (see FIG. 2) so that it is discarded when the cartridge 30 no longer has any of the usable transfer medium 28 therein. This insures that the feed roll 82 does not have any significant reduction in its desired coefficient of friction during use.

After the transfer medium 28 (see FIG. 1), which has a wrap around angle of greater than 90° around the feed roll 82, passes around the feed roll 82, the transfer medium 28 passes the printhead 21 where the transfer medium 28 is heated by the electrodes 27 (see FIG. 5) of the printhead 21 to produce the desired marks on the medium 12 (see FIG. 1). The transfer medium 28 then passes around an idler 91 which is positioned to maintain a relatively low peel angle of the transfer medium 28 with respect to the medium 12. This insures that there is more time for contact with the medium 12 by the transfer medium 28 since the contact time increases as the peel angle decreases.

Figure 10:
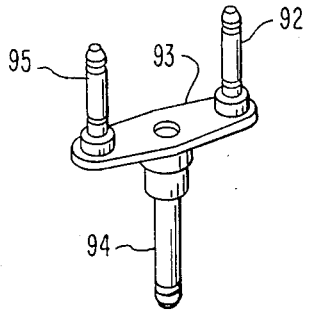
FIG. 10 is a perspective view of a portion of the thermal printer of FIG. 1.

The idler 91 is rotatably supported on a post 92 of a plate 93, which is mounted on the carrier 14 by a downwardly extending post 94 (see FIG. 10). The post 94 is rotatably supported on the plate 17 (see FIG. 3) of the carrier 14 after passing through a bushing 94' on the plate 17 of the carrier 14.

A second post 95 (see FIG. 10) extends upwardly from the plate 93 and has an idler 96 (see FIG. 1) rotatably supported thereby. The transfer medium 28 passes around the idler 96. The spacing of the idler 96 from the idler 91 insures that the transfer medium 28 will not tend to walk up or down the idlers 91 and 96 as could occur if they were positioned too close together. This also avoids any misalignment problems between the posts 92 and 95 as could occur if they were too close together.

After passing around the idler 96, the transfer medium 28 passes around an idler 97 on a tension arm 98, which is pivotally mounted on the carrier 14 by a pivot pin 99 extending through a bushing 99' (see FIG. 3) on the plate 17 of the carrier 14. A spring 100 (see FIG. 17), which has one end attached to the tension arm 98 and its other end connected to the bottom of the plate 17 of the carrier 14, continuously urges the tension arm 98 counterclockwise (as viewed in FIG. 17) about the pivot pin 99 to maintain a desired tension on the transfer medium 28.

After passing around the idler 97, the transfer medium 28 is guided by a roller 101 (see FIG. 1) on a post 102, which has a hole 103 therein to receive one of the pins 62 (see FIG. 2) on the housing cover 32, on the housing base 33. Then, the transfer medium 28 enters the cartridge 30 through the second opening 42 in the side wall 35 of the housing base 33. The transfer medium 28 is then wrapped around the outer cylindrical portion 46 of the take-up spool 43.

The position of the tension arm 98 (see FIG. 1) is sensed by an optical sensor 104 (see FIG. 14), which is mounted on the bottom of the plate 17 (see FIG. 1) of the carrier 14 through having a screw 104A (see FIG. 14) extend through an opening 104B in the optical sensor 104 and a threaded opening 104C (see FIG. 3) in the plate 17. The optical sensor 104 (see FIG. 14) also has a foot 104D extending through an opening 104E (see FIG. 3) in the plate 17 to aid in retaining the optical sensor 104 (see FIG. 14) in position on the plate 17 (see FIG. 3). The optical sensor 104 (see FIG. 14) includes a flag 105 having a cam surface 106 engaged by a pin 107 (see FIG. 13) on the tension arm 98 so that the flag 105 (see FIG. 14) follows the movement of the tension arm 98 (see FIG. 13).

The flag 105 (see FIG. 14) is rotatably supported in a housing 108 of the optical sensor 104 for rotation about the center of a circular portion 109 (see FIG. 15) of the flag 105. The circular portion 109 has a pie-shaped opening 110 therein for cooperation with similar openings in the upper and lower portions of the housing 108 (see FIG. 14) of the optical sensor 104. The housing 108 has an LED in its upper portion and a photosensor in its lower portion so that the amount of light from the LED to the photosensor depends on the position of the pie-shaped opening 110 (see FIG. 15) in the circular portion 109 of the flag 105 relative to the similar pie-shaped openings, which are aligned with each other, beneath the LED and above the photosensor. A spring 111 (see FIG. 14), which has one end connected to a projection 111A on the housing 108 and its other end disposed in a hole 111B (see FIG. 15) in the flag 105, continuously urges the flag 105 about the center of the circular portion 109 so that the cam surface 106 of the flag 105 is held against the pin 107 (see FIG. 13) on the tension arm 98. Thus, the flag 105 (see FIG. 14) always follows the motion of the pin 107 (see FIG. 13) of the tension arm 98. As the light passing through the pie-shaped opening 110 (see FIG. 15) varies because of the position of the tension arm 98 (see FIG. 13) shifting, the optical sensor 104 (see FIG. 14) senses this change in light and activates the take-up motor 59 (see FIG. 7).

The optical sensor 104 (see FIG. 14) is an analog sensor in that it causes advancement of only a very small amount of the transfer medium 28 (see FIG. 1) onto the take-up spool 43 (see FIG. 2) by the take-up motor 59 (see FIG. 7) in accordance with small light variations that it senses because the optical sensor 104 (see FIG. 14) responds to slight changes in the amount of light passing through the pie-shaped opening 110 (see FIG. 15) in the circular portion 108 of the flag 105. One suitable example of the optical sensor 104 (see FIG. 14) is shown and described on pages 6156 and 6157 of Volume 27, No. 10B (March 1985) issue of the IBM Technical Disclosure Bulletin.

The cartridge 30 (see FIG. 1) has its bottom supported on the three pads 31 on the flat plate 17 of the carrier 14. The cartridge 30 is positioned at its desired location on the carrier 14 through having a pair of grooves 117 and 118 in the side wall 35 receive upstanding guides 119 and 120 on the carrier 14 as the cartridge 30 is moved towards the flat plate 17 of the carrier 14.

When it is desired to remove the cartridge 30 from its support on the three pads 31 on the flat plate 17 of the carrier 14, it is necessary to remove the tension on the transfer medium 28. This is accomplished through rotating a lever 121 clockwise (as viewed in FIG. 1) about the center of the supply spool 37 (see FIG. 2) and the center of the take-up spool 43, which are axially aligned with the center of the annular bearing portion 36 of the housing base 33 of the cartridge 30. The lever 121 (see FIG. 11) has a circular opening 121' to receive a portion of the housing 53 (see FIG. 7).

The lever 121 (see FIG. 11) includes a pair of upstanding arcuate segments 122 and 123 extending into arcuate openings 124 (see FIG. 3) and 125, respectively, in the flat plate 17 of the carrier 14. The arcuate segments 122 (see FIG. 11) and 123 of the lever 121 extend into arcuate openings 126 (see FIG. 2) and 127, respectively, in the floor 34 of the housing base 33 of the cartridge 30 when the cartridge 30 is positioned on the carrier 14 (see FIG. 1). The floor 34 (see FIG. 16) of the housing base 33 has a portion 128 at one end of the arcuate opening 126 and a portion 129 at one end of the arcuate opening 127. The portions 128 and 129 are formed to extend upwardly at an angle to the floor 34 of the housing base 33 and support the core 36' (see FIG. 2) of the supply spool 37 on their inner ends.

The portion 129 (see FIG. 16) has a downwardly extending portion 130 at its inner end for engagement by a cam surface 131 (see FIG. 11) on the arcuate segment 123 of the lever 121 to enable the arcuate segment 123 to move the portion 129 (see FIG. 16) into the plane of the floor 34 when the lever 121 (see FIG. 11) is rotated counterclockwise (as viewed in FIG. 1). The arcuate segment 122 (see FIG. 11) of the lever 121 has a cam surface 132 to simultaneously move the portion 128 (see FIG. 16) into the plane of the floor 34 by engaging a downwardly extending portion 132A at the inner end of the portion 128 in the same manner as the cam surface 131 (see FIG. 11) on the arcuate segment 123 moves the portion 129 (see FIG. 16) into the plane of the floor 34 of the housing base 33. This not only locks the cartridge 30 to the carrier 14 (see FIG. 1) through the arcuate segments 122 (see FIG. 11) and 123 overlapping the portions 128 (see FIG. 16) and 129, respectively, and engaging raised portions 132B and 132C, respectively, of the floor 34 but it also enables withdrawal of a tooth 133 on the portion 128 and a tooth 134 on the portion 129 from teeth 135 (see FIG. 2), which are on both sides of the core 36' of the supply spool 37, on the bottom side of the core 36'.

When the teeth 133 and 134 are engaging the teeth 135 on the bottom side of the core 36' of the supply spool 37, the supply spool 37 is prevented from accidental rotation. This insures that the transfer medium 28 is not accidentally withdrawn from the cartridge 30 before it is to be used while handling during loading.

The lever 121 (see FIG. 11) has a finger 136 integral therewith carrying a roller 137 on its end for disposition within a slot 138 (see FIG. 17) in a bellcrank 139, which is rotatably mounted on a pin 140 carried by the flat plate 17 of the carrier 14. The roller 137 extends through an arcuate groove 141, which has the same center as the center of the lever 121, in the flat plate 17 of the carrier 14 for disposition within the slot 138 in the bellcrank 139.

When the lever 121 is rotated clockwise (as viewed in FIG. 17), the roller 137 causes counterclockwise rotation of the bellcrank 139 about the pin 140. This results in an arm 142 of the bellcrank 139 engaging a pin 143 on the plate 73 to rotate the plate 73 about the axis of the pivot pin 74 against the force of a spring 144. The clockwise rotation of the plate 73 about the pivot pin 74 renders the drag brake 70 ineffective through removing the pad 75 from cooperating with the back-up pin 71.

The clockwise rotation of the plate 73 causes a tab 145 on the plate 73 to engage a pin 146 on a portion of the bottom of the printhead holder 22 beneath the printhead 21 to rotate the printhead holder 22 counterclockwise about the pin 23. This moves the printhead 21 including the electrodes 27 (see FIG. 5) away from the transfer medium 28 (see FIG. 17).

The bellcrank 139 has a pin 147 on a second finger 148 and disposed in a slot 149 in a toggle 150. The toggle 150 also is connected to the post 92 so that counterclockwise rotation of the bellcrank 139 about the pin 140 moves the pin 147 from the upper portion of the slot 149 in the toggle 150 to rotate the plate 93 clockwise (as viewed in FIG. 17) about the axis of the post 94 (see FIG. 10). This eliminates the tension on the transfer medium 28 (see FIG. 17) between the idlers 91 and 96.

The clockwise (as viewed in FIG. 17) rotation of the lever 121 also causes the tension arm 98 to be rotated clockwise about the axis of the pivot pin 99 against the force of the spring 100. This is accomplished through an arm 151 (see FIG. 11), which is pivotally mounted on the carrier 14 (see FIG. 4) by a pivot pin 152 extending downwardly from the bottom of the plate 17 of the carrier 14, having a finger 153 (see FIG. 11) on one end engaged by a roller 154 on the bottom of the lever 121 to cause counterclockwise rotation of the arm 151. This results in a sector gear 155, which is on the opposite end of the arm 151 from the finger 153, rotating a sector gear 156 (see FIG. 13), which is integral with the tension arm 98, to rotate the tension arm 98 clockwise (as viewed in FIG. 1) about the pivot pin 99.

After the tension on the transfer medium 28 is removed through clockwise (as viewed in FIG. 1) rotation of the lever 121, the cartridge 30 is removed from its support on the flat plate 17 of the carrier 14. Then, another of the cartridges 30 is positioned so that the grooves 117 and 118 in the side wall 35 of the cartridge 30 receive the upstanding guides 119 and 120, respectively, on the carrier 14 as the cartridge 30 is moved downwardly to position the cartridge 30 on the pads 31 after which the lever 121 is rotated counterclockwise (as viewed in FIG. 1) to return the drag brake 70 to its operative position, the printhead 21 to its operative position, the idlers 91 and 96 to their tension producing positions, and the tension arms 98 to its tension producing position.

Slippage of the transfer medium 28 with respect to the feed roll 82 occurs when $T_1/T_2 > e^{\mu\alpha}$ or $T_2/T_1 > e^{\mu\alpha}$ where $T_1$ is the take-up tension, $T_2$ is the premetering tension, e is a constant defining the natural logarithm, $\mu$ is the coefficient of friction between the transfer medium 28 and the feed roll 82, and $\alpha$ is the wrap around angle in radians of the transfer medium 28 around the fed roll 82. However, as long as $e^{\mu\alpha}$ is greater than $T_1/T_2$ or $T_2/T_1$, there will be no slippage. Accordingly, the ratio of $T_1/T_2$ or $T_2/T_1$ is maintained as low as possible. Furthermore, $T_1$ and $T_2$ are maintained substantially constant so that this ratio does not change.

The take-up tension, $T_1$, is created by the spring 100 acting on the tension arm 98. Through the use of the optical sensor 104 (see FIG. 14), the take-up tension $T_1$ is maintained substantially constant.

The premetering tension $T_2$ is the sum of the tension created by the drag brake 70 (see FIG. 1) and the unwind tension at the supply spool 37 (see FIG. 2). Since the unwind tension at the supply spool 37 is of lesser magnitude, it is only necessary to maintain the tension created by the drag brake 70 see (FIG. 1) substantially constant irrespective of the coefficient of friction between the drag brake 70 and the transfer medium 28. With the tension created by the drag brake 70 equal to the product of the normal force of the transfer medium 28 on the drag brake pad 75 and the sum of the coefficient of friction between the transfer medium 28 and the drag brake pad 75 and the coefficient of friction between the transfer medium 28 and the back-up pin 71, the tension created by the drag brake 70 is substantially constant. This is because the normal force varies inversely to the sum of the coefficients of friction through positioning the idler 81 on the pivot plate 73 to decrease the normal force exponentially as the sum of the coefficients of friction increases. This exponential relation is shown by the dash line in FIG. 18 wherein the normalized force is the normal force divided by the maximum normal force with the maximum normal force being the normal force when $\mu=0$.

As the transfer medium 28 (see FIG. 17) passes around the idler 81, it tends to cause the idler 81 to exert a clockwise moment of force about the pivot pin 74. This moment is increased as the frictional force of the transfer medium 28 on the drag brake 70 increases so as to relieve the normal force.

Figure 18:
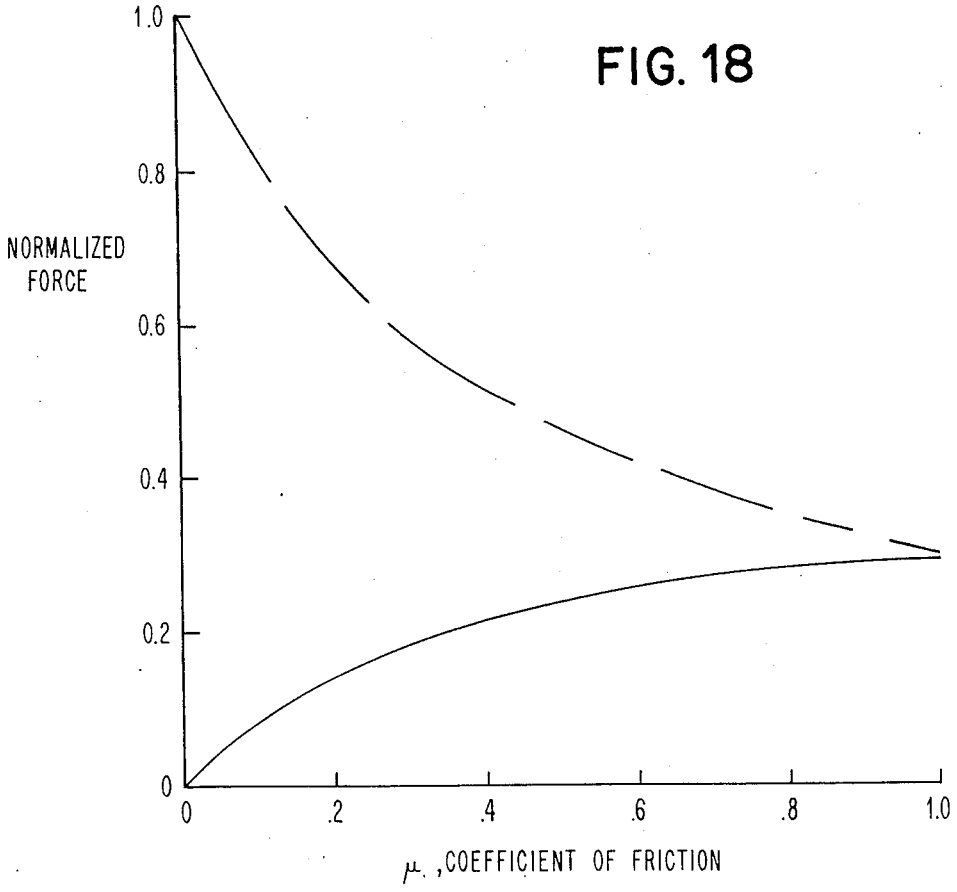
FIG. 18 is a graph showing the relation of the normal force between a thermal transfer medium and a drag brake having a pad of felt and a back-up metal pin and the coefficient of friction between the thermal transfer medium and the drag brake and the relation of a premetering tension force on the thermal transfer medium and the coefficient of friction between the thermal transfer medium and the drag brake.

The solid line in FIG. 18 shows the relationship of the ratio of the tension created by the drag brake 70 to the maximum normal force relative to the sum of the coefficients of friction between the transfer medium 28 and the drag brake pad 75 and between the transfer medium 28 and the back-up pin 71. A change of 300% in the coefficient of friction (0.3 to 0.9, for example) only results in a maximum change in tension of 50% since the maximum normal force is constant. Since there is usually much less change in the coefficient of friction than 300% and the coefficient of friction of the pad 75, when it is felt, relative to the transfer medium 28 is about 0.4 and the coefficient of friction of the back-up pin 71, when it is metal, relative to the transfer medium 28 is about 0.3 so that the sum of the coefficients of friction is about 0.7, the tension created by the drag brake 70 remains substantially constant.

Accordingly, through proper positioning of the idler 81 so that the premetering tension $T_2$ remains substantially constant, the ratio of $T_1/T_2$ is maintained substantially constant and relatively low. Therefore, there will not be slippage of the transfer medium 28 relative to the feed roll 82 whereby a substantially constant velocity of the feed of the transfer medium 28 is obtained with this being the tangential velocity of the outer surface 86 (see FIG. 12) of the feed roll 82 as driven by the motor 90.

While the transfer medium 28 (see FIG. 2) has been shown as being supplied from the core 36' of the supply spool 37 of the cartridge 30, it should be understood that the feed mechanism of the present invention may be readily utilized with any source of the transfer medium 28. Thus, any other type of cartridge could be utilized or the transfer medium 28 could be supplied from other than a cartridge, if desired.

It is desired that the ratio of $T_1/T_2$ or $T_2/T_1$ be capable of being at least 3 to accommodate dynamic loading. This is accomplished by selecting the material of the coefficient of friction of the outer surface 86 (see FIG. 12) of the feed roll 82 so that it will have a coefficient of friction of at least 0.7.

While the transfer medium 28 (see FIG. 1) has been shown and described as being a heat transfer medium, it should be understood that the cartridge 30 could be utilized with the transfer medium 28 being other than a heat transfer medium. Thus, any other suitable type of transfer medium could be utilized with the cartridge 30.

While the cartridge 30 has been shown and described as being used with the thermal printer 10, it should be understood that the cartridge 30 could be employed with any printer in which it is desired to have the feed roll 82 supported on the cartridge 30 to control the length of time that the feed roll 82 is used before being replaced.

An advantage of this invention is that it conserves the use of ribbon at different rates of conservation depending upon the desired print quality. Another advantage of this invention is that it avoids deterioration of the feed or metering roll for feeding the transfer medium past the printhead. A further advantage of this invention is that there is automatic replacement of the feed or metering roll when a predetermined amount of ribbon has been fed by the feed or metering roll. Still another advantage of this invention is that it overcomes the tendency for friction of the ribbon at the recording medium to negate underfeed. A still further advantage of this invention is that it has a low peel angle when used with a thermal transfer medium to increase the contact time of the thermal transfer medium with the recording or receiving medium such as a sheet of paper. Yet another advantage of this invention is that changes in the coefficient of friction between the transfer medium and the drag brake do not affect the premetering tension on the transfer medium.

While the invention has been particularly shown and described with reference to a preferred embodiment thereof, it will be understood by those skilled in the art that various changes in form and detail may be made therein without departing from the spirit and scope of the invention.

What is claimed is:

1. A mechanism for feeding a thermal transfer medium from a source past a thermal printhead for printing from areas of the transfer medium heated by the printhead including:

feed means disposed between the transfer medium source and the printhead for feeding the transfer medium past the printhead at a substantially constant velocity, said feed means including friction means having friction contact with the transfer medium;

said friction means being disposed close enough to the printhead to maintain at least the portion of the transfer medium between said friction means and the printhead substantially stiff during printing;

first tension means disposed in the feed path prior to said friction means to maintain a substantially constant first tension on the transfer medium prior to said friction means with said friction means effective second tension means to maintain a substantially constant second tension on the transfer medium beyond the printhead;

and drive means to independently drive said friction means to feed the transfer medium past the printhead at a selected rate.

2. The mechanism according to claim 1 in which:

said friction means includes a feed roll, said feed roll has the transfer medium wrap around more then 90° of its outer surface;

and said feed roll has its outer surface of a relatively high coefficient of friction to maintain engagement with the transfer medium.

3. The mechanism according to claim 2 including means continuously disposed in the path of the transfer medium between the printhead and said second tension means to maintain the peel angle of the transfer medium relative to a recording medium as low as possible.

4. The mechanism according to claim 3 in which said first tension means includes drag means disposed between said feed roll and the transfer medium source to maintain the substantially constant first tension on the transfer medium irrespective of the coefficient of friction between said drag means and the transfer medium, said second tension means and said drag means cooperating to maintain a substantially constant ratio of the second tension created by said second tension means and the first tension created by said drag means to insure that there is no slippage of the transfer medium relative to said feed roll.

5. The mechanism according to claim 4 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad on said plate to maintain contact of said pad with the entire height of the transfer medium passing between said pin and said pad;

and means supported on said plate downstream in the feed path of the transfer medium from said pin and said pad and positioned to be engaged by the transfer medium prior to said feed roll to remove any increase in normal force created on said pad by the transfer medium passing between said pin and said pad so that the substantially constant first tension is maintained on the transfer medium prior to said feed roll.

6. The mechanism according to claim 5 in which said supported means of said drag means is positioned on said plate relative to said feed roll to guide the transfer medium so that the transfer medium wraps around more than 90° of the outer surface of said feed roll.

7. The mechanism according to claim 2 in which said first tension means includes drag means disposed between said friction means and the transfer medium source to maintain the substantially constant first tension on the transfer medium irrespective of the coefficient of friction between said drag means and the transfer medium, said second tension means and said drag means cooperating to maintain a substantially constant ratio of the second tension created by said second tension means and the first tension created by said drag means to insure that there is no slippage of the transfer medium relative to said feed roll.

8. The mechanism according to claim 7 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad to maintain contact of said pad with the entire height of the transfer medium passing between said pin and said pad;

and means supported on said plate downstream in the feed path of the transfer medium from said pin and said pad and positioned to be engaged by the transfer medium prior to said friction means to remove any increase in normal force created on said pad by the transfer medium passing between said pin and said pad so that the substantially constant first tension is maintained on the transfer medium prior to said friction means.

9. The mechanism according to claim 2 including means continuously disposed in the path of the transfer medium between the printhead and said second tension means to maintain the peel angle of the transfer medium relative to a recording medium as low as possible.

10. The mechanism according to claim 9 in which said first tension means includes drag means disposed between said friction means and the transfer medium source to maintain the substantially constant first tension on the transfer medium irrespective of the coefficient of friction between said drag means and the transfer medium, said second tension means and said drag means cooperating to maintain a substantially constant ratio of the second tension created by said second tension means and the first tension created by said drag means to insure that there is no slippage of the transfer medium relative to said friction means.

11. The mechanism according to claim 10 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad to maintain contact of said pad with the entire height of the transfer medium passing between said pin and said pad;

and means supported on said plate downstream in the feed path of the transfer medium from said pin and said pad and positioned to be engaged by the transfer medium prior to said friction means to remove any increase in normal force created on said pad by the transfer medium passing between said pin and said pad so that the substantially constant first tension is maintained on the transfer medium prior to said friction means.

12. The mechanism according to claim 1 in which said first tension means includes drag means disposed between said friction means and the transfer medium source to maintain the substantially constant first tension on the transfer medium irrespective of the coefficient of friction between said drag means and the transfer medium, said second tension means and said drag means cooperating to maintain a substantially constant ratio of the second tension created by said second tension means and the first tension created by said drag means to insure that there is no slippage of the transfer medium relative to said friction means.

13. The mechanism according to claim 12 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad to maintain contact of said pad with the entire height of the transfer medium passing between said pin and said pad;

and means supported on said plate downstream in the feed path of the transfer medium from said pin and said pad and positioned to be engaged by the transfer medium prior to said friction means to remove any increase in normal force created on said pad by the transfer medium passing between said pin and said pad so that the substantially constant first tension is maintained on the transfer medium prior to said friction means.

14. A thermal printer including:

a thermal printhead;

a transfer medium source supported for movement with said printhead;

moving means for moving said printhead relative to a print receiving location;

feed means for feeding the transfer medium from said source past said printhead at a substantially constant selected velocity for printing from areas of said transfer medium heated by said printhead;

said feed means including friction means disposed close enough to said printhead to maintain at least the portion of the transfer medium between said printhead and said friction means substantially stiff during printing;

first tension means disposed between said friction means and said transfer medium source to maintain a substantially constant first tension on the transfer medium with said friction means effective;

and second tension means to maintain a substantially constant second tension on the transfer medium beyond said printhead.

15. The thermal printer according to claim 14 in which:

said friction means includes a feed roll, said feed roll has the transfer medium wrap around more than 90° of its outer surface;

and said feed roll has its outer surface of a relatively high coefficient of friction to maintain engagement with the transfer medium.

16. The thermal printer according to claim 15 including means continuously disposed in the path of the transfer medium between said printhead and said second tension means to maintain the peel angle of the transfer medium relative to a recording medium as low as possible.

17. The thermal printer according to claim 16 in which said outer surface of said feed roll is selected from the group consisting of urethane microcellular foam, urethane rubber, and polyvinyl chloride.

18. The thermal printer according to claim 17 including:

a carrier supporting said printhead for movement therewith, said moving means moving said carrier;

a cartridge removably supported on said carrier, said cartridge having said transfer medium source;

said cartridge supporting said feed roll;

said feed means including driving means for driving said feed roll;

and said carrier supporting said driving means.

19. The thermal printer according to claim 16 including:

a carrier supporting said printhead for movement therewith, said moving means moving said carrier;

a cartridge removably supported on said carrier, said cartridge having said transfer medium source;

said cartridge supporting said feed roll;

said feed means including driving means for driving said feed roll;

and said carrier supporting said driving means.

20. The thermal printer according to claim 15 including:

a carrier supporting said printhead for movement therewith, said moving means moving said carrier;

a cartridge removably supported on said carrier, said cartridge having said transfer medium source;

said cartridge supporting said feed roll;

said feed means including driving means for driving said feed roll;

and said carrier supporting said driving means.

21. The thermal printer according to claim 15 in which said first tension means includes drag means disposed between said feed roll and said transfer medium source to maintain the substantially constant first tension on the transfer medium irrespective of the coefficient of friction between said drag means and the transfer medium, said second tension means and said drag means cooperating to maintain a substantially constant ratio of the second tension created by said second tension means and the first tension created by said drag means to insure that there is no slippage of the transfer medium relative to said feed roll.

22. The thermal printer according to claim 21 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad on said plate to maintain contact of said pad with the entire height of the transfer medium passing between said pin and said pad;

and means supported on said plate downstream in the feed path of the transfer medium from said pin and said pad and positioned to be engaged by the transfer medium prior to said feed roll to remove any increase in normal force created on said pad by the transfer medium passing between said pin and said pad so that the substantially constant first tension is maintained on the transfer medium prior to said feed roll.

23. The thermal printer according to claim 22 in which said supported means of said drag means is positioned on said plate relative to said feed roll to guide the transfer medium so that the transfer medium wraps around more than 90° of the outer surface of said feed roll.

24. The thermal printer according to claim 14 in which said first tension means includes drag means disposed between said friction means and said transfer medium source to maintain the substantially constant first tension on the transfer medium irrespective of the coefficient of friction between said drag means and the transfer medium, said second tension means and said drag means cooperating to maintain a substantially constant ratio of the second tension carried by said second tension means and the first tension created by said drag means to insure that there is no slippage of the transfer medium relative to said friction means.

25. The thermal printer according to claim 24 in which said drag means includes:

a pivotally mounted plate;

a back-up pin mounted on said plate;

a pad of a selected material mounted on said plate and cooperating with said pin to create a drag on the transfer medium passing therebetween, the selected material of said pad having a relatively low coefficient of friction relative to the transfer medium;

means to gimbally mount said pad to maintain contact of said pad with the entire height of the transfer medium passing between said pin and said pad;

and means supported on said plate downstream in the feed path of the transfer medium from said pin and said pad and positioned to be engaged by the transfer medium prior to said friction means to remove any increase in normal force created on said pad by the transfer medium passing between said pin and said pad so that the substantially constant first tension is maintained on the transfer medium prior to said friction means.

26. The thermal printer according to claim 14 including means continuously disposed in the path of the transfer medium between said printhead and said second tension means to maintain the peel angle of the transfer medium relative to a recording medium as low as possible.

27. The thermal printer according to claim 14 including:

a carrier supporting said printhead for movement, said moving means moving said carrier;

a cartridge removably supported on said carrier, said cartridge having said transfer medium source;

said cartridge supporting said friction means;

said feed means including driving means for driving said friction means;

and said carrier supporting said driving means.

28. A cartridge including:

a main body having an extension;

said main body having a transfer medium rotatably supported therein, said transfer medium exiting from said main body and returning to said main body to provide a continuous portion of said transfer medium exterior of said main body for utilization for printing;

a feed roll for feeding said transfer medium from said main body when said feed roll is driven, said feed roll being rotatably supported by said extension;

and said feed roll having its outer surface engage said transfer medium prior to said transfer medium being utilized for printing, said outer surface of said feed roll having a relatively high coefficient of friction with said transfer medium for feeding said transfer medium solely by frictional contact between said transfer medium and said outer surface of said feed roll when said feed roll is driven.

29. The cartridge according to claim 28 in which said outer surface of said feed roll is selected from the group consisting of urethane microcellular foam, urethane rubber, and polyvinyl chloride.

30. A thermal transfer medium feed mechanism for feeding a thermal transfer medium from a source of thermal transfer medium to a thermal printhead at which printing is to occur comprising:

a feed roll having an outer surface of a substantial coefficient of friction positioned between said thermal printhead and said source of thermal transfer medium to be printed from;

means to rotate said feed roll for feeding said thermal transfer medium from said source solely by frictional contact of said outer surface of said feed roll and said thermal transfer medium prior to said thermal transfer medium being used for printing;

and means to guide said thermal transfer medium around at least more than 90° of said outer surface of said feed roll, said guide means being disposed prior to said thermal printhead.

31. The mechanism according to claim 30 in which said feed roll is disposed close enough to said thermal printhead to maintain at least the portion of said thermal transfer medium between said feed roll and said thermal printhead substantially stiff during printing.

32. The mechanism according to claim 30 in which said feed roll has a relatively high torsional rigidity.

33. The mechanism according to claim 30 in which said feed roll includes a core having said outer surface of substantial coefficient of friction thereon, said outer surface having a thickness no greater than 0.5 mm.

34. A cartridge body in which a ribbon transfer medium is contained as a source of transfer medium for printing, said transfer medium exiting from said body and returning to said body to provide a continuous portion of said transfer medium exterior of said body for utilization for printing, said body having an extension, and said extension having mounted thereon a feed roll having its outer surface engage said transfer medium prior to said transfer medium being utilized for printing, said outer surface of said feed roll having a substantial coefficient of friction with said transfer medium operative for feeding of said transfer medium solely by frictional contact between said outer surface of said feed roll and said transfer medium.

35. A thermal printer including:

a thermal printhead;

a carrier supporting said printhead for movement therewith;

moving means for moving said carrier to move said printhead relative to a print receiving location;

a cartridge removably supported on said carrier;

said cartridge including a main body and an extension;

said main body having a transfer medium supported therein, said transfer medium exiting from said main body and returning to said main body to provide a continuous portion of said transfer medium exterior of said main body for utilization for printing;

a feed roll for feeding said transfer medium from said main body when said feed roll is driven, said feed roll being rotatably supported by said extension;

said feed roll having its outer surface engage said transfer medium prior to said transfer medium being utilized for printing, said outer surface of said feed roll having a relatively high coefficient of friction with said transfer medium for feeding said transfer medium solely by frictional contact between said transfer medium and said outer surface of said feed roll when said feed roll is driven;

and driving means supported by said carrier and driving said feed roll.

36. A thermal transfer medium feed mechanism adjacent a downstream thermal printhead comprising:

a source of thermal transfer medium;

a feed roll having an outer surface of a substantial coefficient of friction mounted at a position spaced from said source of thermal transfer medium for being positioned proximate to said thermal printhead;

said feed roll being rotatably mounted to feed said thermal transfer medium from said source solely by frictional contact of said outer surface of said feed roll and said thermal transfer medium;

and said feed roll being positioned to have said thermal transfer medium pass around at least more than 90° of said outer surface of said feed roll.

* * * * *